US011597073B2

(12) United States Patent
Lin

(10) Patent No.: US 11,597,073 B2
(45) Date of Patent: Mar. 7, 2023

(54) HAND TOOL WITH INSULATION HANDLE

(71) Applicant: YIH CHENG FACTORY CO., LTD., Nantuo (TW)

(72) Inventor: Jack Lin, Nantuo (TW)

(73) Assignee: YIH CHENG FACTORY CO., LTD., Nantuo (TW)

( * ) Notice: Subject to any disclaimer, the term of this patent is extended or adjusted under 35 U.S.C. 154(b) by 57 days.

(21) Appl. No.: 17/216,327

(22) Filed: Mar. 29, 2021

(65) Prior Publication Data

US 2022/0305638 A1 Sep. 29, 2022

(51) Int. Cl.

| | |
|---|---|
| ***B25G 1/12*** | (2006.01) |
| ***B25B 23/00*** | (2006.01) |
| ***B25B 15/02*** | (2006.01) |

(52) U.S. Cl.

CPC ..... *B25G 1/125* (2013.01); *B25B 23/0042* (2013.01); *B25B 15/02* (2013.01)

(58) Field of Classification Search

CPC ..... B25G 1/125; B25B 23/0042; B25B 15/02
USPC ..... 81/436, 489, 486
See application file for complete search history.

(56) References Cited

U.S. PATENT DOCUMENTS 6,260,445 B1 * 7/2001 DeVecchis ..... B25B 15/02 81/58
7,467,575 B2 * 12/2008 Lai ..... B25G 3/18 81/177.85
7,762,161 B2 * 7/2010 Lai ..... B25B 15/04 81/58.3
2009/0173192 A1 * 7/2009 Hsieh ..... B25B 23/0035 81/436
2010/0229693 A1 * 9/2010 Chen ..... B25G 3/22 81/438
2010/0269263 A1 * 10/2010 Burch ..... B25B 23/0042 7/165
2012/0167725 A1 * 7/2012 Hsu ..... B25B 23/0042 81/177.2
2019/0299391 A1 * 10/2019 Hu ..... B25B 23/0042

FOREIGN PATENT DOCUMENTS

TW I499486 B 9/2015
TW M576090 U 4/2019

OTHER PUBLICATIONS

Office Action dated Oct. 25, 2021 of the corresponding Taiwan patent application No. 110102720.

* cited by examiner

*Primary Examiner* — Joseph J Hail
*Assistant Examiner* — Christopher Soto
(74) *Attorney, Agent, or Firm* — Chun-Ming Shih; HDLS IPR Services

(57) ABSTRACT

A hand tool with insulation handle. The handle is made of an insulation material and is formed with a hollow portion (11) and an embedding groove (12). The embedding groove (12) is communicated with the hollow portion (11) and located on a front end (101) of the handle. The tool rod (20) includes a shaft (21) having a rear end (211) and a front end (212). The end plug (30) is made of the insulation material and includes a clamping section (31) and an abutting section (32). The rear end (211) of the shaft is positioned in the end plug through snapping the clamping section. The tool rod (20) is replaceablely inserted in the hollow portion (11) of the handle and protrudes from the handle.

16 Claims, 6 Drawing Sheets

HAND TOOL WITH INSULATION HANDLE

BACKGROUND OF THE DISCLOSURE

Technical Field

The technical field relates to a hand tool, and more particularly relates to a hand tool with an insulation handle.

Description of Related Art

Hand tools are one of the necessary tools in telecommunications maintenance or building service works. For related-art hand tools, taking the screwdriver as an example, the structure of the screwdriver is provided with an insulation handle on the rear end of a metal rod, and the steel balls are disposed in the insulation handle for positioning the metal rod. Therefore, the metal rod in the insulation handle can be replaced, so that the front end of the metal rod may be used for locking or loosing operations.

However, when the screwdriver is using, especially in a high-voltage environment, the current is easily to be conducted from the metal rod to the handle. That may cause users to get an electric shock when holding the handle, and cause physical harm to users.

In view of the above drawbacks, the inventor proposes this disclosure based on his expert knowledge and elaborate researches in order to solve the problems of related art.

SUMMARY OF THE DISCLOSURE

One object of this disclosure is to provide a hand tool with an insulation handle. The end plug has proper insulation property to ensure the insulation effect between the tool rod and the handle, so that the current may not be conducted from the tool rod to the handle to increase the safety during usage.

In order to achieve the object mentioned above, this disclosure provides a hand tool with an insulation handle including a handle, a tool rod and an end plug. The handle has an insulation material, and further has a hollow portion and an embedding groove communicated with the hollow portion and located on a front end of the handle. The tool rod includes a shaft having a rear end and a front end located oppositely. The end plug has the insulation material. The end plug includes a clamping section combined in the embedding groove and an abutting section attached to the tool rod. The rear end of the shaft is positioned in the end plug through snapping the clamping section, the tool rod is replaceablely inserted in the hollow portion of the handle and protrudes from the handle.

Comparing to the related art, the hand tool of this disclosure includes a handle, a tool rod and an end plug. The tool rod includes a shaft, and the tool rod is positioned through snapping the clamping section of the end plug, so as to replace the related-art hand tools of utilizing steel balls for positioning the tool rod. Therefore, the tool rod is replaceably positioned in the end plug and combined to the handle. Since the insulating sleeve and the end plug both have proper insulation property, the insulation effect between the tool rod and the handle may be ensured, so that the current may not be conducted to the handle when the tool rod is in contact with the high current, and the safety of usage is enhanced.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
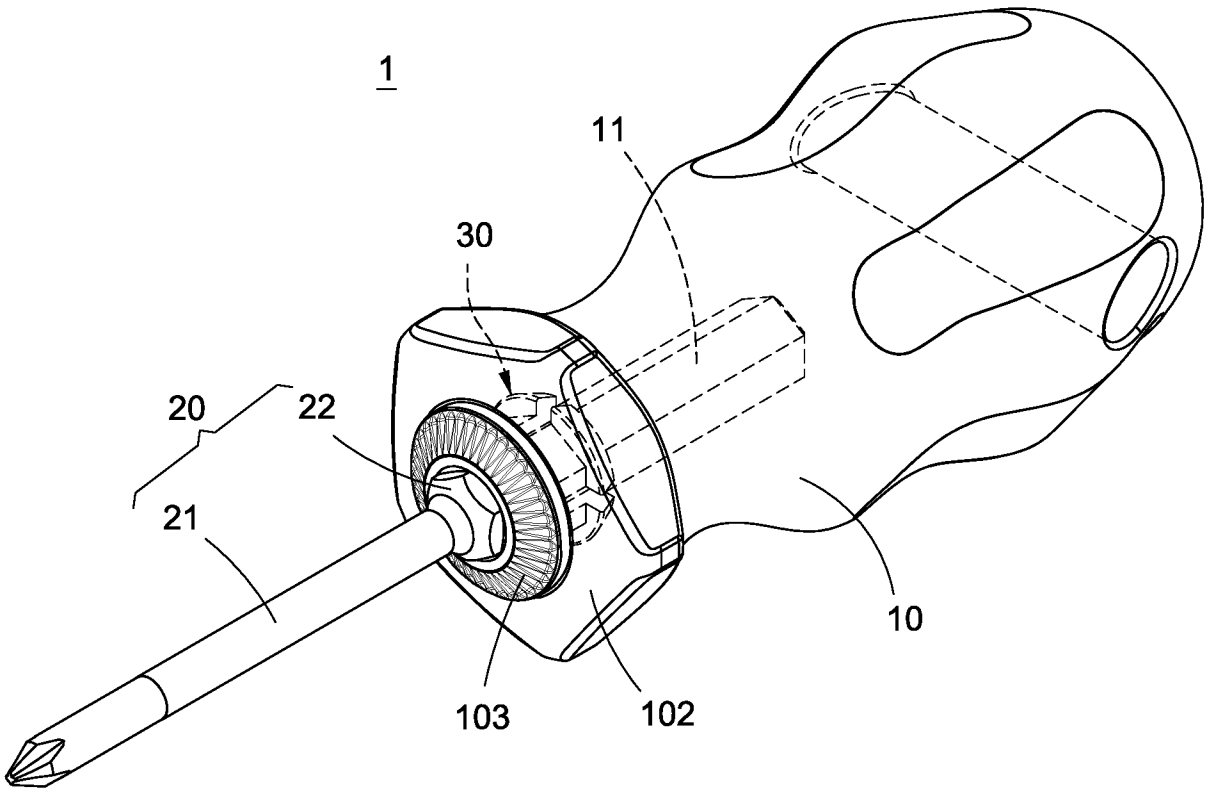
FIG. 1 is a perspective schematic view of the hand tool with the insulation handle of this disclosure.
Figure 2:
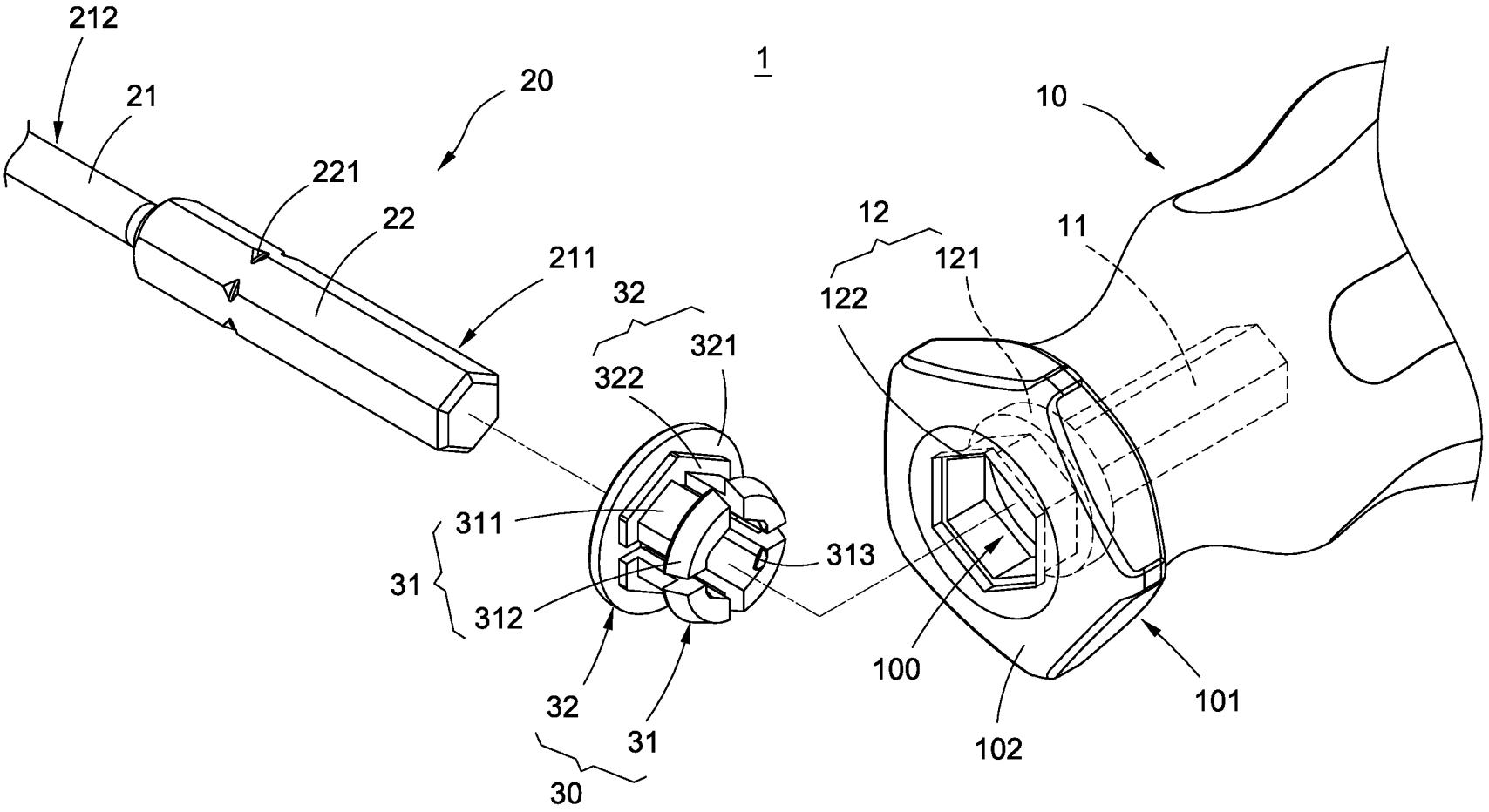
FIG. 2 is a perspective exploded view of the hand tool with the insulation handle of this disclosure.

Please refer to FIG. 1 and FIG. 2, which depict a perspective schematic view and a perspective exploded view of the hand tool with the insulation handle of this disclosure. The hand tool 1 with the insulation handle of this disclosure includes a handle 10, a tool rod 20 and an end plug 30. The end plug 30 is disposed in the handle 10. The tool rod 20 is replaceablely positioned in the end plug 30 and combined with the handle 10 to constitute the hand tool 1. The structure of the hand tool 1 is described in more detail as follows.

The handle 10 is made of an insulation material and has insulation property. The handle 10 is formed with a hollow portion 11 and an embedding groove 12, and the embedding groove 12 is communicated with the hollow portion 11 and located on a front end 101 of the handle 10.

The tool rod 20 includes a shaft 21 and an insulating sleeve 22. In some embodiments, the shaft 21 and the insulating sleeve 22 are integrally formed. The shaft 21 has a rear end 211 and a front end 212 located oppositely. The rear end 211 of the shaft 21 is covered by the insulating sleeve 22 and the front end 212 of the shaft 21 is exposed from the insulating sleeve 22, and an outer surface of the insulating sleeve 22 is provided with a plurality of detent grooves 221.

It is worth noticing that the tool rod 20 may not be provided with the insulating sleeve 22. In some embodiments, the tool rod 20 may be a metal rod in one-piece form, and a plurality of detent grooves or protrusions or other positioning structures are directly disposed on the end of the metal rod.

The end plug 30 is made of the insulation material and has insulation property. The end plug 30 includes a clamping section 31 combined in the embedding groove 12 and an abutting section 32 attached to the tool rod 20. The clamping section 31 includes a plurality of elastic arms 311 arranged spacedly and a plurality of protrusions 312 connected to the elastic arms 311. Moreover, the protrusions 312 have a plurality of detent blocks 313. In the present embodiment, the tool rod 20 is positioned by the end plug 30 positions through the detent blocks 313 snapping (or engaging) the detent grooves 221 of the insulating sleeve 22 (refer to FIG.

5). Additionally, the elastic arms 311 and the protrusions 312 are arranged collectively in a ring shape.

Specifically, one end 102 of the handle 10 is formed with an insertion opening 100. The abutting section 32 includes a cap 321 and a plurality of ribs 322 formed on a bottom of the cap 321. The cap 321 is attached to the end 102, and the ribs 322 abut against the surface of the insertion opening 100. In one of the exemplary embodiments, the end 102 of the handle 10 has a plurality of anti-slip parts 103 (see FIG. 1).

In the present embodiment, the insertion opening 100 is configured of a hexagonal shape, and the ribs 322 are arranged in a hexagonal shape corresponding to the shape of the insertion opening 100. Furthermore, the hollow portion 11 of the handle 10 is configured in a shape of a hexagonal prism, and the rear end 211 of the shaft 21 and the insulating sleeve 22 are configured respectively in a shape of a hexagonal prism corresponding to the hollow portion 11.

Figure 4:
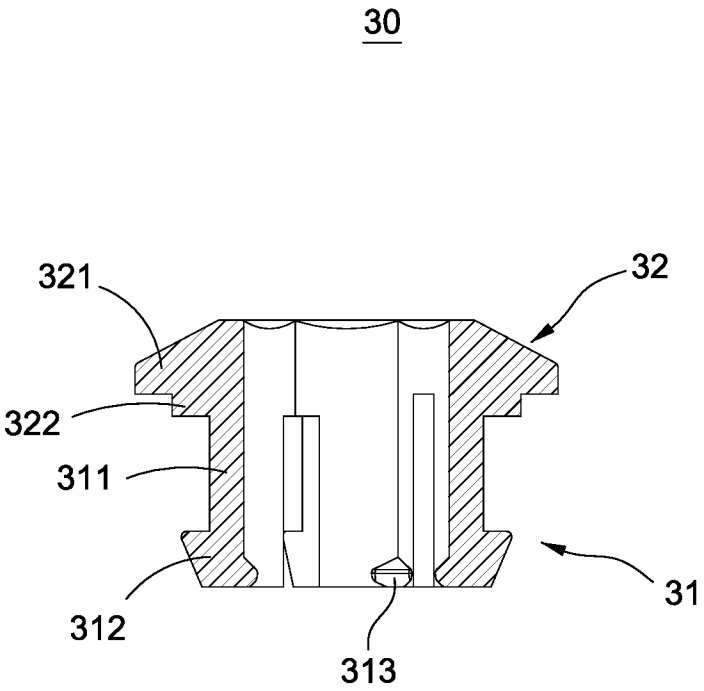
FIG. 3 and FIG. 4 are two cross sectional views of the end plug of this disclosure.
Figure 3:
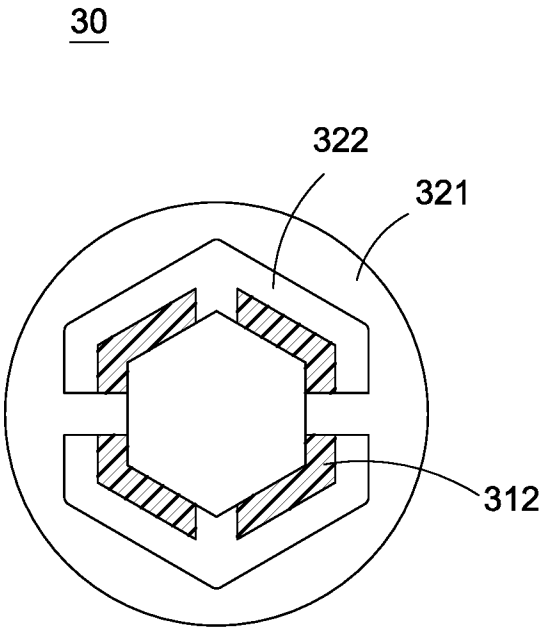

Please further refer to FIG. 3 and FIG. 4, which depict two cross sectional views of the end plug of this disclosure. The end plug 30 includes the clamping section 31 and the abutting section 32. The clamping section 31 includes a plurality of elastic arms 311, protrusions 312 and detent blocks 313. The abutting section 32 includes the cap 321 and a plurality of ribs 322.

In the present embodiment, the elastic arms 311 and the protrusions 312 are arranged collectively in the ring shape, and an outer diameter of the ring shape of the protrusions 312 is greater than an outer diameter of the ring shape of the elastic arms 311 and smaller than an outer diameter of the cap 321.

Figure 5:
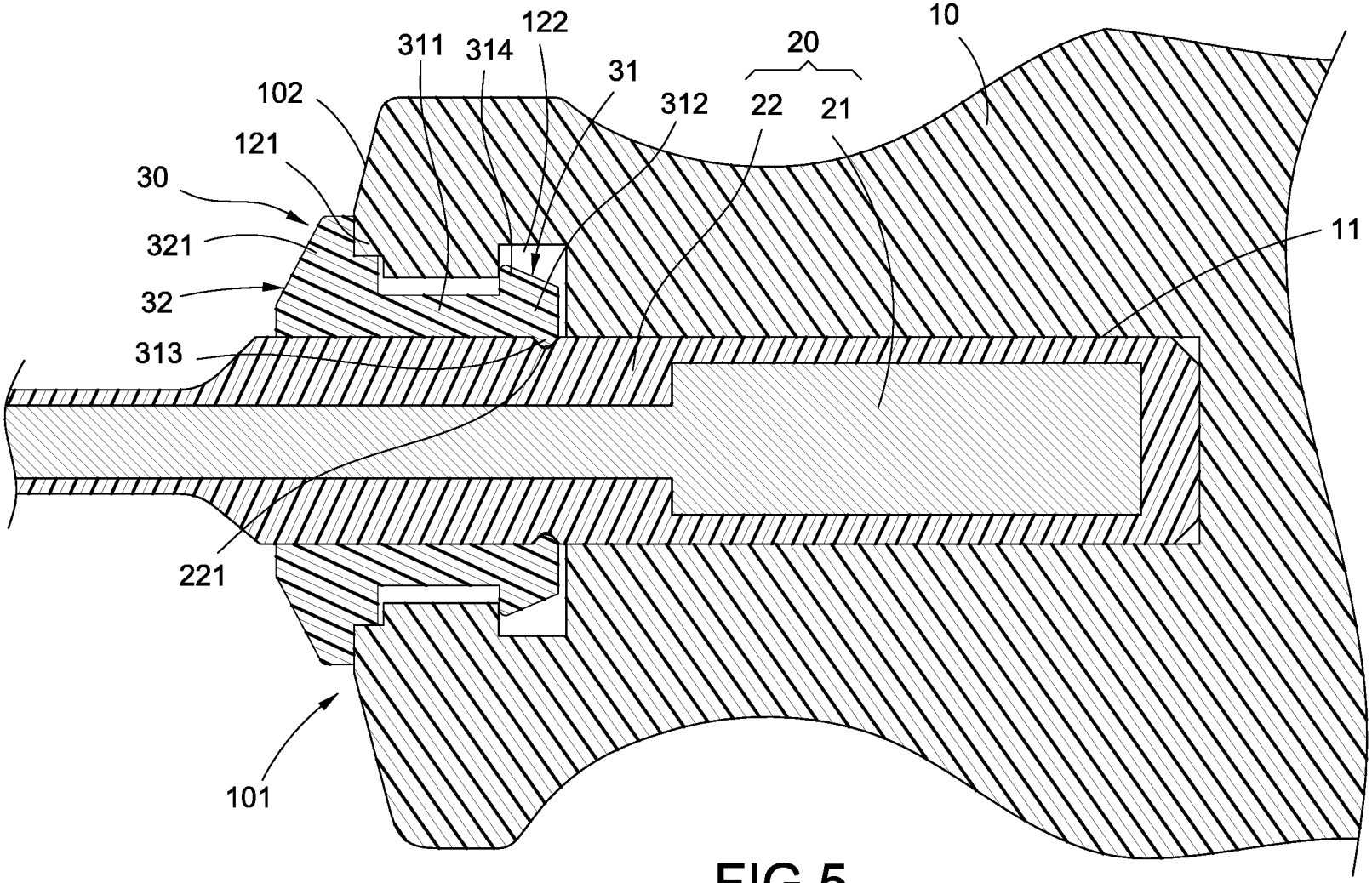
FIG. 5 is a cross sectional view of the combination of the hand tool with the insulation handle of this disclosure.

Please further refer to FIG. 5, which depicts a cross sectional view of the combination of the hand tool with the insulation handle of this disclosure. As shown in the figure, the rear end 211 of the shaft 21 is positioned in the end plug 30 through the detent grooves 221 of the insulating sleeve 22 snapping the clamping section 31, so that the tool rod 20 is replaceablely inserted in the hollow portion 11 of the handle 10 and protrudes from the handle 10. Therefore, the insulation property between the tool rod 20 and the handle 10 is improved, and the current may not be conducted to the handle 10 when the tool rod 20 is in contact with the high current.

Specifically, the embedding groove 12 includes a positioning portion 121 and a concave portion 122. The abutting section 32 of the end plug 30 abuts against the positioning portion 121, and the cap 321 is attached to the end 102 of the handle 10. Additionally, the clamping section 31 has a plurality of hooks 314, and the hooks 314 abut against the concave portion 122.

In the present embodiment, the clamping section 31 has a plurality of protrusions 312, and top edges of the protrusions 312 are formed with hooks 314. The hooks 314 abut against the concave portion 122. Therefore, the end plug 30 may not be detached from the embedding groove 12 and is combined to the front end 101 of the handle 10.

It should be noted that the arrangement of the concave portion 122 may be used as the elastic deformation space for the protrusions 312, so that the protrusions 312 may be elastically deformed to clamp the shaft 21. On the other hand, an external force is applied for pulling the tool rod 20 out of the handle 10 when the tool rod 20 is replacing. At the time, the protrusions 312 may be elastically deformed outwardly so that the shaft 21 is released from the clamping of the protrusions 312, and the replacement of the tool rod 20 is performed.

Figure 6:
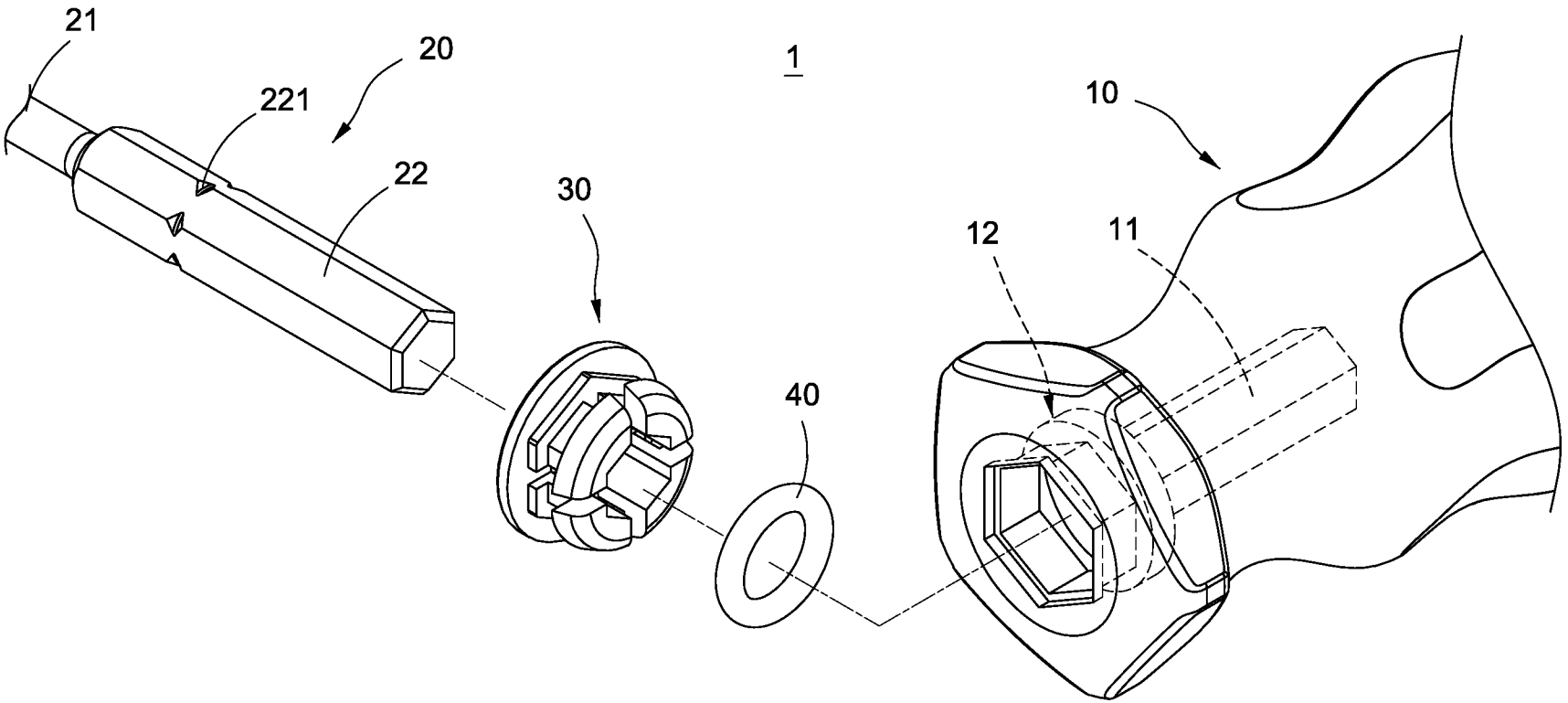
FIG. 6 and FIG. 7 are another embodiment of positioning the tool rod of the hand tool with the insulation handle of this disclosure.
Figure 7:
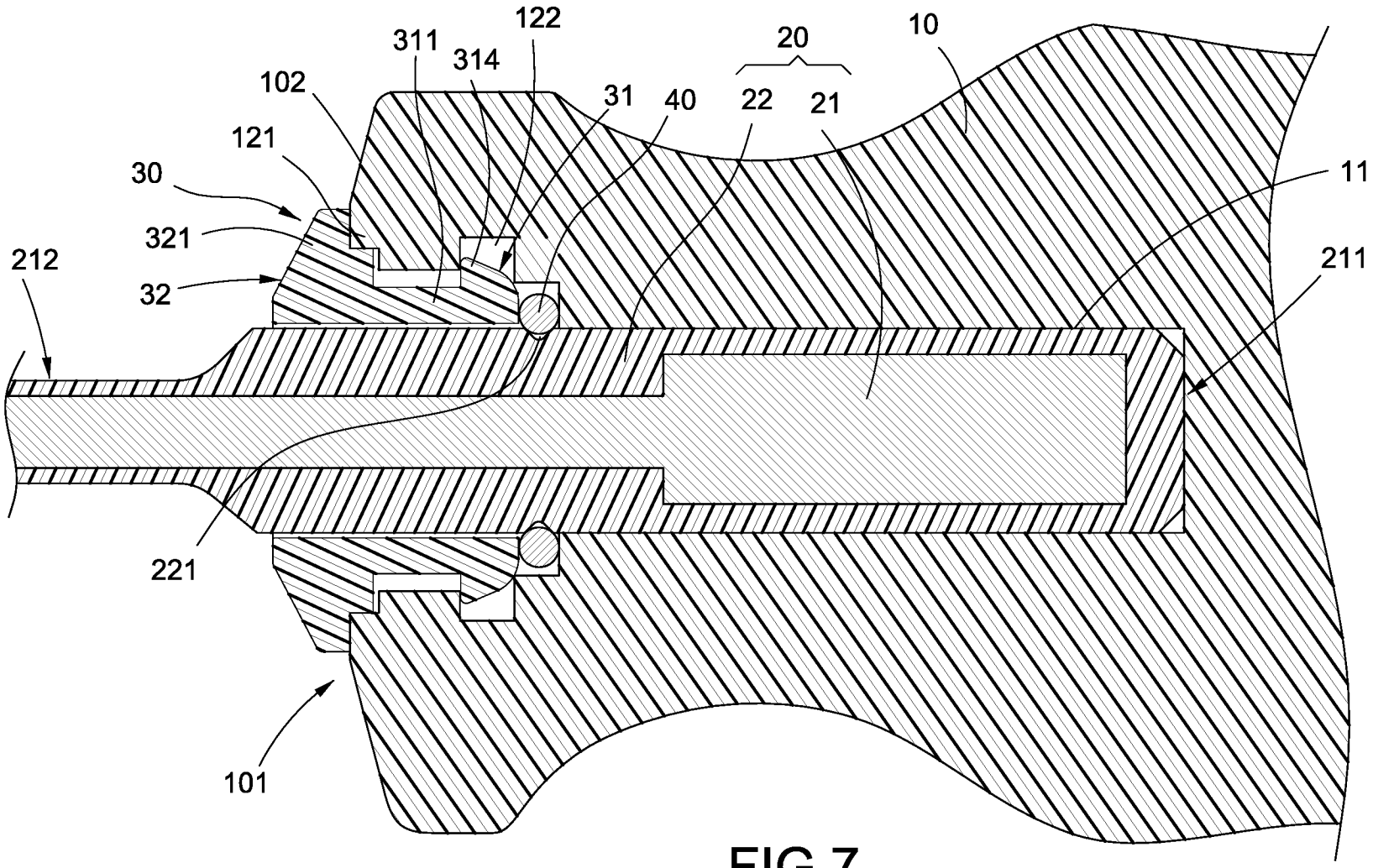

Please further refer FIG. 6 and FIG. 7, which depict another embodiment of positioning the tool rod of the hand tool with the insulation handle of this disclosure. In the present embodiment, the hand tool 1 with the insulation handle further includes an O-ring 40 clamped between the end plug 30 and the handle 10. The O-ring 40 is snapped with the detent grooves 221 of the insulating sleeve 22 to position the tool rod 20. Specifically, the O-ring 40 is disposed in the embedding groove 12 and clamped by the protrusions 312. Therefore, the rear end 211 of the shaft 21 passes through the end plug 30 and is accommodated in the hollow portion 11, and the front end 212 of the shaft 21 protrudes from the end plug 30 for performing locking or loosening operations.

It should be noted that the tool rod 20 is positioned by the O-ring 40 and the detent grooves 221 of the insulating sleeve 22 being snapped with each other, and users may choose another form of tool rod 20 for replacement.

While this disclosure has been described by means of specific embodiments, numerous modifications and variations could be made thereto by those skilled in the art without departing from the scope and spirit of this disclosure set forth in the claims.

What is claimed is:

1. A hand tool with an insulation handle, the hand tool comprising:

a handle (10), comprising an insulation material, and further comprising a hollow portion (11) and an embedding groove (12) communicated with the hollow portion (11) and located on a front end (101) of the handle (10);

a tool rod (20), comprising a shaft (21) with a rear end (211) and a front end (212) located oppositely; and an end plug (30), comprising the insulation material, and further comprising a clamping section (31) combined in the embedding groove (12) and an abutting section (32) attached to the tool rod (20);

wherein the rear end (211) of the shaft (21) is positioned in the end plug (30) through snapping the clamping section (31), the tool rod (20) is replaceablely inserted in the hollow portion (11) of the handle (10) and protrudes from the handle (10);

wherein the embedding groove (12) comprises a positioning portion (121) and a concave portion (122), and the abutting section (32) abuts against the positioning portion (121), and the clamping section (31) comprises a plurality of hooks (314), and the hooks (314) abut against the concave portion (122);

wherein the clamping section (31) comprises a plurality of elastic arms (311) arranged spacedly and a plurality of protrusions (312) connected to the elastic arms (311), and the hooks (314) are disposed on top edges of the protrusions (312).

2. The hand tool with the insulation handle according to claim 1, wherein an insertion opening (100) is disposed on an end surface (102) of the handle (10), and the abutting section (32) comprises a cap (321) and a plurality of ribs (322) disposed on a bottom of the cap (321), and the cap (321) is attached to the end surface (102), and the ribs (322) abuts against a surface of the insertion opening (100).

3. The hand tool with the insulation handle according to claim 2, wherein the insertion opening (100) is configured in a hexagonal shape, and the ribs (322) are arranged collectively in the hexagonal shape corresponding to the insertion opening (100).

4. The hand tool with the insulation handle according to claim 1, wherein the tool rod (20) further comprises an insulating sleeve (22), and the rear end (211) of the shaft (21) is covered by the insulating sleeve (22), and a plurality of detent grooves (221) are disposed on an outer surface of the insulating sleeve (22), and the rear end (211) of the shaft (21) is positioned in the end plug (30) through the detent grooves (221) of the insulating sleeve (22) snapping the clamping section (31).

5. The hand tool with the insulation handle according to claim 4, wherein the hollow portion (11) is configured in a shape of a hexagonal prism, and the rear end (211) of the shaft (21) and the insulating sleeve (22) are configured respectively in the shape of the hexagonal prism corresponding to the hollow portion (11).

6. The hand tool with the insulation handle according to claim 4, further comprising: an O-ring (40), clamped between the end plug (30) and the handle (10), wherein the tool rod (20) is positioned through the O-ring (40) snapping the detent grooves (221) of the insulating sleeve (22).

7. The hand tool with the insulation handle according to claim 1, wherein the elastic arms (311) and the protrusions (312) are arranged collectively in a ring shape respectively, and an outer diameter of the ring shape of the protrusions (312) is greater than an outer diameter of the ring shape of the elastic arms (311) and smaller than an outer diameter of the cap (321).

8. The hand tool with the insulation handle according to claim 1, wherein the protrusions (312) comprise a plurality of detent blocks (313), and a plurality of detent grooves (221) are disposed on an outer surface of the insulating sleeve (22), and the tool rod is positioned by the end plug (30) through the detent blocks (313) snapping the detent grooves (221) of the insulating sleeve (22).

9. A hand tool with an insulation handle, the hand tool comprising:

a handle (10), comprising an insulation material, and further comprising a hollow portion (11) and an embedding groove (12) communicated with the hollow portion (11) and located on a front end (101) of the handle (10);

a tool rod (20), comprising a shaft (21) with a rear end (211) and a front end (212) located oppositely;

an end plug (30), comprising the insulation material, and further comprising a clamping section (31) combined in the embedding groove (12) and an abutting section (32) attached to the tool rod (20);

wherein the rear end (211) of the shaft (21) is positioned in the end plug (30) through snapping the clamping section (31), the tool rod (20) is replaceablely inserted in the hollow portion (11) of the handle (10) and protrudes from the handle (10);

wherein the tool rod (20) further comprises an insulating sleeve (22), and the rear end (211) of the shaft (21) is covered by the insulating sleeve (22), and a plurality of detent grooves (221) are disposed on an outer surface of the insulating sleeve (22), and the rear end (211) of the shaft (21) is positioned in the end plug (30) through the detent grooves (221) of the insulating sleeve (22) snapping the clamping section (31); and an O-ring (40), clamped between the end plug (30) and the handle (10), wherein the tool rod (20) is positioned through the 0-ring (40) snapping the detent grooves (221) of the insulating sleeve (22).

10. The hand tool with the insulation handle according to claim 9, wherein the embedding groove (12) comprises a positioning portion (121) and a concave portion (122), and the abutting section (32) abuts against the positioning portion (121), and the clamping section (31) comprises a plurality of hooks (314), and the hooks (314) abut against the concave portion (122).

11. The hand tool with the insulation handle according to claim 9, wherein an insertion opening (100) is disposed on an end surface (102) of the handle (10), and the abutting section (32) comprises a cap (321) and a plurality of ribs (322) disposed on a bottom of the cap (321), and the cap (321) is attached to the end surface (102), and the ribs (322) abuts against a surface of the insertion opening (100).

12. The hand tool with the insulation handle according to claim 11, wherein the insertion opening (100) is configured in a hexagonal shape, and the ribs (322) are arranged collectively in the hexagonal shape corresponding to the insertion opening (100).

13. The hand tool with the insulation handle according to claim 9, wherein the hollow portion (11) is configured in a shape of a hexagonal prism, and the rear end (211) of the shaft (21) and the insulating sleeve (22) are configured respectively in the shape of the hexagonal prism corresponding to the hollow portion (11).

14. The hand tool with the insulation handle according to claim 9, wherein the clamping section (31) comprises a plurality of elastic arms (311) arranged spacedly and a plurality of protrusions (312) connected to the elastic arms (311), and the hooks (314) are disposed on top edges of the protrusions (312).

15. The hand tool with the insulation handle according to claim 14, wherein the elastic arms (311) and the protrusions (312) are arranged collectively in a ring shape respectively, and an outer diameter of the ring shape of the protrusions (312) is greater than an outer diameter of the ring shape of the elastic arms (311) and smaller than an outer diameter of the cap (321).

16. The hand tool with the insulation handle according to claim 14, wherein the protrusions (312) comprise a plurality of detent blocks (313), and a plurality of detent grooves (221) are disposed on an outer surface of the insulating sleeve (22), and the tool rod is positioned by the end plug (30) through the detent blocks (313) snapping the detent grooves (221) of the insulating sleeve (22).

* * * * *